United States Patent [19]

Beck et al.

[11] Patent Number: 4,894,499

[45] Date of Patent: Jan. 16, 1990

[54] ELECTRIC PUSH-BUTTON SWITCH

[75] Inventors: Hans Beck, Zürich; Heinz Waser, Schlieren; Peter Bettschart, Zürich, all of Switzerland

[73] Assignee: Contraves AG, Zürich, Switzerland

[21] Appl. No.: 249,610

[22] Filed: Sep. 26, 1988

[30] Foreign Application Priority Data

Sep. 30, 1987 [CH] Switzerland ..... 03794/87

[51] Int. Cl.[4] ..... H01H 5/02

[52] U.S. Cl. ..... 200/404; 200/468; 200/5 A; 200/532; 200/536; 200/341; 200/241; 335/205

[58] Field of Search ..... 200/404, 468, 402, 520, 200/532, 530, 535, 534, 536, 341, 342, 344, 345, 241, 242, 252, 253, 283, 5 A; 335/205–207

[56] References Cited

U.S. PATENT DOCUMENTS

| | | | |
|---|---|---|---|
| 1,336,066 | 4/1920 | Briggs et al. | 200/532 |
| 2,134,770 | 11/1938 | Weber | 74/503 |
| 3,056,000 | 9/1962 | Lucas | 200/404 |
| 3,809,838 | 5/1974 | Coppola | 200/532 |
| 4,354,081 | 10/1982 | Serras-Paulet | 200/404 |
| 4,440,992 | 5/1984 | Desmarais | 200/517 |
| 4,447,681 | 5/1984 | Desmarais | 200/5 A |
| 4,467,160 | 8/1984 | Murmann et al. | 200/536 |
| 4,514,609 | 4/1985 | Fricke et al. | 200/532 |
| 4,678,880 | 7/1987 | Koizumi | 200/513 |

FOREIGN PATENT DOCUMENTS

| | | | |
|---|---|---|---|
| 25629 | 3/1981 | European Pat. Off. | 200/536 |
| 0028561 | 5/1981 | European Pat. Off. . | |
| 2706463 | 8/1977 | Fed. Rep. of Germany | 200/536 |
| 2823367 | 12/1979 | Fed. Rep. of Germany . | |
| 3119227 | 12/1982 | Fed. Rep. of Germany | 200/404 |
| 2395546 | 1/1979 | France . | |

*Primary Examiner*—Ernest G. Cusick
*Attorney, Agent, or Firm*—Werner W. Kleeman

[57] ABSTRACT

The electric push-button switch comprises a housing portion and a linearly moveable push-button portion. Guide columns at the housing portion and the push-button portion attain accurate linear guiding and rotational positioning of the push-button portion. These guide columns mutually interact or interengage and are in multiple line contact with one another. This multiple line contact extends in the direction of movement of the push-button portion. The length of such line contact is variable between a rest position and an operating position of the push-button portion. This line contact is greatest when the push-button portion assumes its operating position. A contact surface of a fixed counter contact comprises a planar slide surface for resilient contact arms carried by the push-button portion. The friction arising during the forced sliding movement of the resilient contact arms over the contact surface produces self-cleaning of the contacts and damping of contact chatter movements. The contact chatter time, even when eccentrically actuating the push-button switch, can be decisively shortened by the exact guidance and damping of the movements. A snap-action, which is to be overcome when actuating the push-button switch, advantageously comprises a permanent magnetic cover plate at the housing portion and an armature plate at the push-button portion. The push-button switch can be used for single switches or for switches forming component parts of a push-button panel or switchboard having a common housing portion.

6 Claims, 2 Drawing Sheets

ELECTRIC PUSH-BUTTON SWITCH

BACKGROUND OF THE INVENTION

The present invention broadly relates to electric switches and, more particularly, concerns a new and improved construction of an electric or electrical push-button switch.

Generally speaking, the electric push-button switch of the present invention is of the type comprising a housing portion or component which contains fixed counter contacts and a push-button portion or component which is generally linearly moveable in relation to the housing portion between a rest position and an operating position while overcoming a snap-action mechanism. There is also provided a contact bridge or bridge structure comprising resilient contact arms intended to coact with the fixed counter contacts. These resilient contact arms are inclined with respect to the direction of linear motion of the push-button portion.

A prior art push-button switch of this general type periodically displayed uncertain contact making, in particular, a too long chatter or bounce time following actuation of the push-button switch. This phenomenon is undesired, especially when the push-button switch is used in conjunction with electronic circuits. Additionally, it has been found that the chatter or bounce time is markedly dependent upon whether the plunger at the push-button portion is centrally or eccentrically actuated, in other words, so-to-speak, dead-center or off-center. A closer study and analysis of this prior art push-button switch has found that the ascertained flaws or defects partially were attributable to a design of the contacts which was not optimum, but especially, however, to an insufficient guidance of the moveable push-button portion. It was found that there not only existed a chatter or bounce of the resilient contact arms as such, but also there were present uncontrolled oscillations of the entire push-button portion which were superimposed upon the actuating or actuation path of the push-button switch.

SUMMARY OF THE INVENTION

Therefore, with the foregoing in mind, it is a primary object of the present invention to provide a new and improved construction of an electric push-button switch which does not suffer from the aforementioned drawbacks and shortcomings of the prior art.

Another and more specific object of the present invention aims at providing a new and improved construction of an electric push-button switch with which there is realized as short as possible contact chatter or bounce time together with reliable and faultless contact making.

Still a further notable object of the present invention is directed to the provision of a new and improved construction of an electric push-button switch which is relatively simple in construction and design, quite economical to manufacture, extremely reliable in operation, not readily subject to breakdown or malfunction and requires a minimum of maintenance and servicing.

Now in order to implement these and still further objects of the invention, which will become more readily apparent as the description proceeds, the electric push-button switch of the present development, among other things, is manifested by the features that the housing portion and the push-button portion are provided with coacting or mutually engaging or interleaving guide columns or posts for the purpose of generally linearly guiding and rotatably positioning the push-button portion. These guide columns are in multiple line or linear contact with one another. This line contact extends in the direction of movement of the push-button portion, and the length of such line contact is variable during movement of the push-button portion and is maximized in the operating position of the push-button portion.

With such design of the push-button switch, the contact chatter or bounce time can be dramatically shortened, in fact, far below a value of five milliseconds as such is required for numerous fields of application. With only modest friction due to the line contact, there is achieved an effective linear guidance and alignment of the rotary or rotational position of the push-button portion, which reach their maximum effectiveness at the moment contact is made and throughout a subsequent follow-through or post movement during which the contact pressure is increased. Consequently, there is precluded "fluttering" of the push-button portion, and specifically, this is accomplished extensively independent of whether the push-button plunger is operated at its central or middle region or at its edge or marginal region.

The counter contacts each can be advantageously constructed as a substantially planar or flat sliding surface each facing the associated contact arm formed with double or paired contacts. With this construction of the push-button switch and in conjunction with the effective guidance of the push-button portion, there can be realized an additional damping of the contact chatter or bounce movements and a self-cleaning of the contacts.

According to a further aspect of the invention, the guide columns or posts, viewed in the direction of movement of the push-button portion, are advantageously arranged at a region or area located between the counter contacts.

A still further feature of the invention contemplates that a centrally arranged guide column of the housing portion possesses an impact or stop surface for the push-button portion, this impact or stop surface determining the operating or working position of such push-button portion.

A still further aspect of this invention contemplates that the push-button switch is a component of a push-button array, in other words, a push-button panel or switchboard, comprising a plurality of push-button switches containing a common housing portion or component.

The push-button switch of the present development can be particularly advantageously utilized in conjunction with a permanent magnetic snap-action mechanism. This snap-action mechanism can be constituted by a permanent magnetic plate at the housing portion or component and an armature plate which is connected with the push-button portion or component. With this arrangement, the actuation force at the start of actuation of the push-button switch is maximum, and upon so to speak, "tearing away" the magnetically retained armature plate then abruptly declines. This exceedingly favorable force-displacement characteristic is hardly impaired by virtue of the inventive linear guiding or the push-button portion or component.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
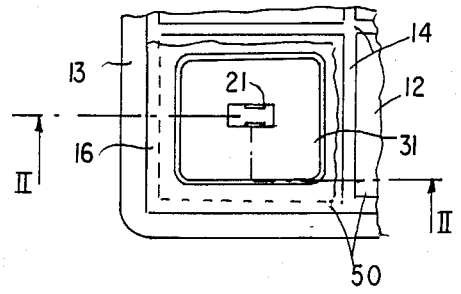
FIG. 1 illustrates in fragmentary top plan view, a push-button switch constituting part of a push-button switch array, in other words, part of a push-button switch panel or board.
Figure 2:
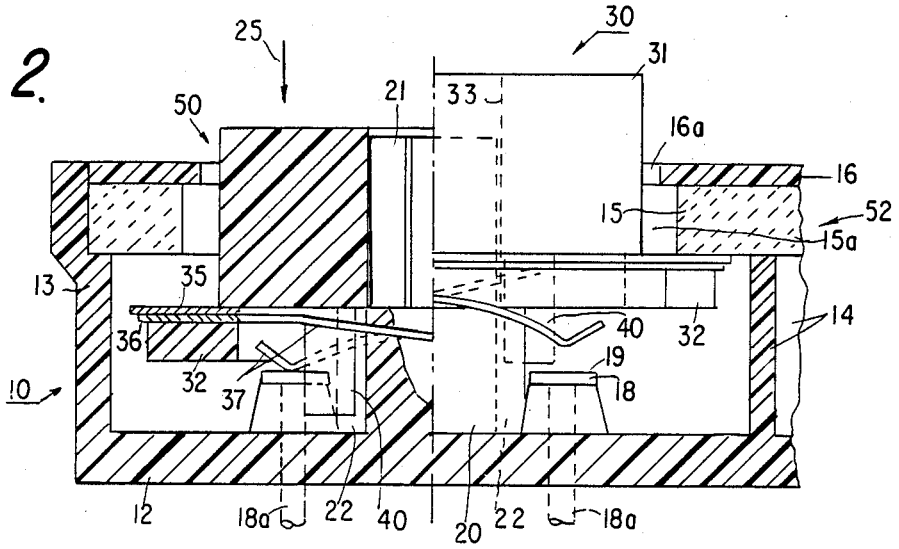
FIG. 2 is an enlarged sectional view of the push-button switch depicted in FIG. 1, taken substantially along the line II—II thereof, wherein the push-button portion is shown at the left-hand side in its operating or working position and at the right-hand side, in its rest or ineffectual position.

Describing now the drawings, it is to be understood that to simplify the illustration thereof, only enough of the structure of the electric push-button switch constructed according to the teachings of the present invention has been illustrated therein as is needed to enable one skilled in the art to readily understand the underlying principles and concepts of this invention. Turning specifically now to FIGS. 1 and 2 of the drawings, there will be recognized an electric push-button switch, generally indicated by reference character 50, which comprises a housing portion or component 10 and a push-button portion or component 30, as particularly well recognized by inspecting FIG. 2. As is well known in the art, and as has been depicted in FIG. 1, a plurality of similar or identical switches 50, such as four rows and four columns each containing four such switches 50, can be united to form a push-button switch array or so-called push-button switch panel or board in that the housing portion 10 thereof is structured in one piece and is common for all of the push-button switches 50 of such push-button switch panel or board.

The housing portion or component 10 has a continuous generally flat or planar base or floor 12 from which protrude sidewalls or wall members 13 as well as the intermediate walls or wall members 14. Preferably two fixed counter contacts or contact members 18 containing connection pins or terminals **18*a* leading out of the rear face of the housing base or floor 12 are provided for each push-button switch 50 at such housing base or floor 12. Two plates or plate members 15 and 16 are located substantially parallel to and in spaced relation from the housing base or floor 12 to form a cover or closure member, generally indicated by reference numeral 52. Each of these two plates or plate members 15 and 16 is provided with an appropriate opening or throughpassage, for instance, a rectangular opening or throughpassage 15*a* and 16*a*, respectively, for the reception of the push-button portion 30 of the associated push-button switch 50. These plates or plate members 15 and 16, after the assembly of the push-button switch array or panel, are connected in any appropriate fashion with the housing base or floor 12. In the embodiment shown, the plate or plate member 15 is formed of a suitable permanent magnetic material and preferably from a mixture of plastics material and magnetizable metal powder. The other plate or plate member 16** is formed of steel and serves as a magnetic shield or screen.

Figure 3:
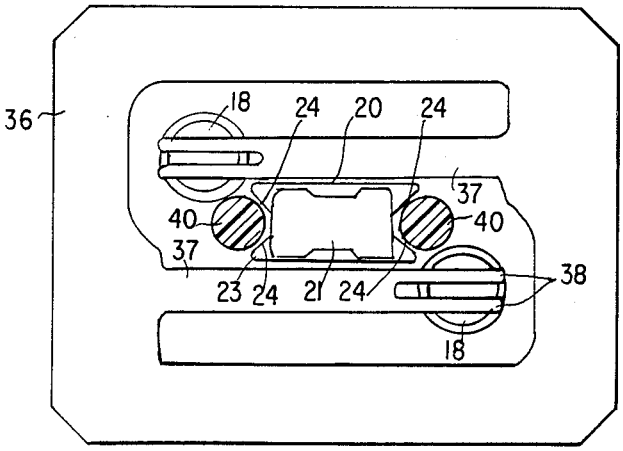
FIG. 3 is a top plan view of the contact bridge or bridge structure of the fixed counter contacts and the guide columns or posts.

Between the counter contacts or contact members 18 which are located approximately along a diagonal of the rectangular housing base or floor 12 as seen in FIG. 3, there is formed or otherwise appropriately provided at the center or central region of the housing base or floor 12, a guide column or post 20 having an extension 21 for guiding the associated push-button portion 30. This push-button portion 30 possesses an actuation plunger or plunger member 31 which protrudes beyond the plates 15 and 16 and a substantially rectangular flange or flange member 32 which is connected with the actuation plunger 31. A substantially planar or flat, generally rectangular armature plate or plate member 35 formed of steel and a contact bridge or bridge structure 36 are retained between the actuating or actuation plunger 31 and the flange 32. The design of the contact bridge 36 will be particularly evident upon inspecting FIG. 3. It will be seen that this contact bridge 36 comprises two downwardly inclined resilient contact arms or arm members 37. Each of these resilient contact arms 37 terminates in double or paired contacts 38 which coact with the associated fixed or stationary counter contact or contact member 18.

In the rest position or mode of the push-button portion 30, as shown at the right-hand side of FIG. 2, the armature plate 35 bears against the underside of the magnetic plate 15 and is retained thereby due to the permanent magnetic action. The plate 15 and the armature plate 35 thus form a snap-action mechanism which can be overcome by depressing the actuating plunger 31 of the push-button portion 30 in the movement or displacement direction indicated by the arrow 25 in FIG. 2. After the so-to-speak "tearing away" of the armature plate 35 from the magnetic plate 15, the magnetic force of attraction rapidly diminishes with increasing distance between the moveable armature plate 35 from the stationary magnetic plate 15, so that the push-button portion 30 suddenly moves into the operating position and there is established the contact connection between both of the counter contacts or contact members 18. In the operating position of the push-button switch 50, as shown at the left-hand side of FIG. 2, the magnetic forces are still sufficiently great that after release of the actuating plunger 31, the push-button portion 30 again is raised or shifted back into its aforedescribed rest position.

Figure 4:
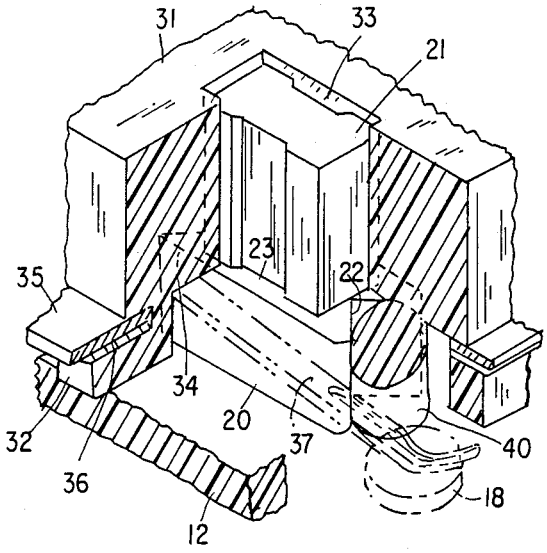
FIG. 4 illustrates in perspective view and partially in section, the central parts of the push-button switch.

During the movement of the push-button portion 30 of the push-button switch 50 between the rest position and the operating position, in the aforementioned movement direction indicated by the arrow 25, this push-button portion 30 is loosely guided by the column-like extension or prolongation 21 of the guide column or post 20. This column-like extension or prolongation 21 engages in an appropriately configured recess or cavity 33 provided at the actuating plunger 31, as will be recognized by referring to FIG. 2. For the exact linear guiding of the push-button portion 30 as well as also for the positioning thereof in a defined rotational or rotary position i.e. in a defined position which is secured against rotation, there is advantageously provided the following construction or arrangement:

The guide column or column member 20 of the housing portion 10 possesses two oppositely situated substantially V-shaped guide grooves 22 and at the push-button portion 30, there are formed or otherwise provided at the underside or bottom face 34 of the actuating plunger 31, two generally cylindrical guide columns or posts 40. Each of these guide columns or posts 40 engage in, or coact with, an associated one of the V-shaped guide grooves or recesses 22, so that there is provided at a total of four locations, a line contact 24 in the direction of the linear motion 25 of the push-button portion 30. Since in the explained manner, the guide columns or posts 40 of the push-button portion 30 and the guide column or post 20 of the housing portion 10 mutually coact or engage with one another, the length of each such line contact, during actuation or operation of the push-button portion 30 of the push-button switch 50 increases upon movement of the push-button portion 30 from the rest position into the operating or working position and is maximized in the aforenoted operating position. This operating position, in other words, the lower terminal position of the push-button portion 30 is defined or delimited by an impact or stop surface 23 of the guide column or post 20 at the region of transition to the column extension or prolongation 21. At this impact or stop surface 23, there comes to bear the underside or lower face 34 of the actuating plunger 31 of the push-button portion 30, as best seen by referring to FIG. 4.

The described arrangement of the mutually engaging or interacting guide columns or posts 20 and 40 in conjunction with the terminal stop or impact structure 23 and 34, renders possible an effective and precise motion guidance and positioning of the push-button portion 30, particularly at the end or terminal region of the movement when the contact making operation is accomplished, so that there is beneficially reduced the contact chatter or bounce time. Compared with the guiding action or guidance which is obtained by only the column extension or prolongation 21, it is to be observed that in the operating position of the push-button portion 30, there is achieved approximately a two-fold or doubling of the guide length. For the effectiveness of the guiding action, it has been found to be advantageous if, as illustrated, the guide columns 20 and 40, viewed in the movement direction indicated by the arrow 25, are located in a region or area disposed between the counter contacts or contact members 18, and equally it is beneficial if the impact or stop surface 23 for the push-button portion 30 is provided at the centrally arranged guide column 20 of the housing portion 10. The attained linear guiding action is also then effective when the actuation of the push-button portion 30 of the push-button switch 50 is undertaken at the marginal region of the actuating plunger 31 instead of at the central region thereof.

Figure 5:
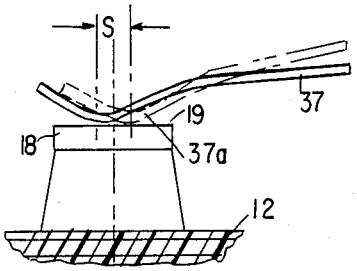
FIG. 5 illustrates on an enlarged scale, details of the contact structure and the mode or operation of the push-button switch depicted in FIGS. 1 through 4.

As will be particularly recognized by referring to FIG. 2, in the rest position of the push-button portion 30, the spacing between the contact arms or arm members 37 and the counter contacts or contact means 18 is less than the path through which the push-button portion 30 moves until reaching the operating or working position thereof. This in effect means that subsequent to the initial touching of the contact structure, namely the initial abutment of the contact arms 37 at the two fixed contacts 18, there occurs a post-movement of the push-button portion 30 until reaching the end or terminal position thereof, and during which each of the contact arms or arm members 37 is resiliently bent so that there is perfected the requisite contact pressure. In FIG. 5, there has been depicted the position of an end or end region **37*a* of one of the contact arms 37 at the moment of first contact with the associated counter contact 18 in chain-dot lines and the position of this end or end region 37*a* of the contact arm 37 when it has reached its terminal or final position at the related fixed counter contact 18** has been shown in full lines.

Advantageously, the contact surface 19 of each fixed counter contact 18 and which confronts the related contact arm 37, possesses a substantially planar or flat configuration. By virtue of the quite precise lengthwise or linear guiding of the push-button portion 30 with very little rotary play thereof, each contact arm 37 during this post-movement as shown in FIG. 5, is caused to automatically perform or forced to perform, a sliding movement, indicated by reference character S in FIG. 5, upon the associated planar or flat contact surface 18. This is in marked contrast to a rolling movement which would be present if there was used a domed contact surface. Due to the aforementioned sliding movement, there is achieved an effective self-cleaning of the contacts or contact structure 18 and 37 and the therewith associated sliding friction causes an additional damping of the chatter or bounce movements of the contact arms 37. Also the construction of the double or paired contacts 38 at the ends of each of the contact arms 37 contributes to the achievement of a positive contact connection or contact-making operation.

The depicted design of the guide columns or posts 20 and 40, with the guide column 20 generally centrally arranged at the housing portion 10 and provided with oppositely situated substantially V-shaped guide grooves 22, has proven to be quite advantageous for space reasons for the given contact arrangement. Of course, and thus it should be understood, there are numerous other possibilities for the construction or design of the mutually engaging or coacting guide columns or posts which afford multiple line contact. Hence, in this connection there are schematically depicted two variant embodiments or modifications, simply as examples and not for purposes of limitation, in the illustrations of FIGS. 6 and 7.

Figure 6:
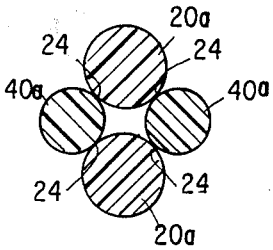
FIG. 6 schematically illustrates in sectional view, a further possible design of the mutually coacting or engaging guide columns or posts according to a modified construction of the push-button switch.
Figure 7:
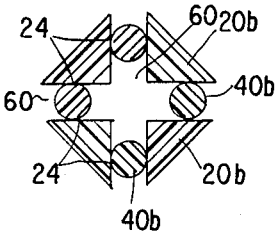
FIG. 7 schematically illustrates in sectional view, a further possible design of the coacting or mutually engaging guide columns or posts of a still further modified construction of the push-button switch.

By referring to FIG. 6, it will be seen that both at the housing portion, like the housing portion 10 of FIG. 1, as well as at the push-button portion, like the push-button portion 30 of such FIG. 1, there are provided a respective pair of generally cylindrical and coacting guide columns **20*a* and 40*a*, and at four locations there is present a respective line contact 24 for the lengthwise guidance and rotational positioning of the push-button portion 30 of the related push-button switch like the push-button switch 50 depicted in FIG. 1**.

With the exemplary embodiment depicted in FIG. 7, wherein again the housing portion, like the housing portion 10 of FIG. 1 and the push-button portion, like the push-button portion 30 of such FIG. 1, have been conveniently omitted, it will be recognized that four multiple-edge, here triangular guide columns or posts **20*b* at the housing portion, form intersecting slots 60 with which engage the arms of respective generally cylindrical guide columns or posts 40*b* of the push-button portion, to provide in each case, the associated line contact 24. It will be observed that in this case, eight such line or linear contacts or contact locations 24** are achieved.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. An electric push-button switch, comprising:

a housing portion;

fixed counter contact means including a plurality of spaced counter contacts provided for the housing portion;

a push-button portion which is generally linearly moveable in a predetermined direction of movement;

means defining a snap-action mechanism for said push-button portion;

said push-button portion being generally linearly moveable between a rest position and an operating position while overcoming a snap action of said snap-action mechanism;

contact bridge means comprising resilient contact arms provided for coaction with said fixed counter contact means;

said fixed counter contact means being contactingly engaged by said resilient contact arms when said push-button portion assumes said operating position;

said resilient contact arms being inclined with respect to said predetermined direction of movement of the push-button portion;

said housing portion being provided with guide column means;

said push-button portion being provided with guide column means;

said guide column means of said housing portion and said guide column means of said push-button portion mutually contactingly engaging with one another for generally linearly guiding and securing said push-button portion against undesired rotation;

said guide column means of said housing portion and said guide column means of said push-button portion, viewed in the predetermined direction of movement of said push-button portion, being arranged at a region located between said plurality of spaced counter contacts;

said guide column means of said housing portion and said guide column means of said push-button portion being in multiple linear non-planar contact with one another and which multiple linear non-planar contact extends in said predetermined direction of movement of the push-button portion; and said multiple linear non-planar contact changing in length during the movement of said push-button portion and being greatest when said push-button portion assumes said operating position thereof.

2. The electric push-button switch as defined in claim 1, wherein:

each of said resilient contact arms is structured to provide a double-contact arrangement; and each of said plurality of fixed counter contacts has a substantially planar sliding surface confronting a related contact arm structured as the double-contact arrangement.

3. The electric push-button switch as defined in claim 2, further including:

said guide column means of said housing portion define a substantially centrally arranged guide column;

said substantially centrally arranged guide column of said housing portion possessing an impact surface which defines the operating position of the said push-button portion.

4. The electric push-button switch as defined in claim 1, wherein:

said push-button switch constitutes part of a push-button switch array comprising a plurality of said push-button switches arranged in said housing portion which defines a common housing portion.

5. The electric push-button switch as defined in claim 1, wherein:

said snap-action mechanism comprises:

a permanent magnetic plate provided at the housing portion; and an armature plate connected with the said push-button portion.

6. An electric push-button switch, comprising:

a housing portion;

fixed counter contact means provided for the housing portion;

a push-button portion generally linearly moveable in a predetermined direction of movement;

means defining a snap-action mechanism for said push-button portion;

said push-button portion being generally linearly moveable between a rest position and an operating position while overcoming a snap action of said snap-action mechanism;

resilient contact means carried by said push-button portion and positioned to be placed into contact with said fixed counter contact means;

said fixed counter contact means being contactingly engaged by said resilient contact means when said push-button portion assumes said operating position;

said housing portion being provided with guide column means;

said push-button portion being provided with guide column means;

said guide column means of said housing portion and said guide column means of said push-button portion mutually contactingly cooperating with one another for generally linearly guiding and securing said push-button portion against undesired rotation;

said guide column means of said housing portion and said guide column means of said push-button portion being in multiple linear non-planar contact with one another and which multiple linear non-planar contact extends in said predetermined direction of movement of the push-button portion; and said multiple linear non-planar contact changing in length during the movement of the said push-button portion and being greatest when said push-button portion assumes said operating position thereof.

* * * * *